United States Patent [19]

Roth

[11] Patent Number: 4,677,797

[45] Date of Patent: Jul. 7, 1987

[54] KNOCKDOWN HOUSING STRUCTURE

[76] Inventor: Herman Roth, 233 Keap St., Brooklyn, N.Y. 11211

[21] Appl. No.: 865,414

[22] Filed: May 21, 1986

[51] Int. Cl.[4] ..... E04B 7/02; E04C 1/10; E04C 1/30

[52] U.S. Cl. ..... 52/94; 52/204; 52/282; 52/570; 52/582; 52/585; 52/586

[58] Field of Search ..... 52/282, 582, 585, 586, 52/94, 204, 570; 446/124, 127, 128

[56] References Cited

U.S. PATENT DOCUMENTS

| | | | |
|---|---|---|---|
| 2,204,319 | 6/1940 | Parsons et al. | 52/282 X |
| 3,076,286 | 2/1963 | Czecholinski | 52/585 X |
| 3,286,423 | 11/1966 | Donlon | 52/282 X |
| 3,305,982 | 2/1967 | Steele | 52/593 X |
| 3,438,164 | 4/1969 | Duepree | 52/585 X |
| 3,729,889 | 5/1973 | Baruzzini | 52/586 X |
| 3,731,956 | 5/1973 | Hanley | 52/582 |

FOREIGN PATENT DOCUMENTS

| | | | |
|---|---|---|---|
| 163421 | 6/1955 | Australia | 52/582 |
| 241008 | 10/1960 | Australia | 52/582 |
| 1151104 | 7/1963 | Fed. Rep. of Germany | 52/582 |
| 1349422 | 12/1963 | France | 52/582 |
| 483085 | 7/1953 | Italy | 446/124 |
| 434972 | 9/1935 | United Kingdom | 446/127 |
| 624251 | 5/1945 | United Kingdom | 52/585 |
| 795078 | 5/1958 | United Kingdom | 52/585 |
| 1527420 | 10/1978 | United Kingdom | 446/124 |

*Primary Examiner*—Alfred C. Perham

*Attorney, Agent, or Firm*—Goodman & Teitelbaum

[57] ABSTRACT

A knockdown housing structure formed of a number of wall panels which are interconnected together. The wall panels are slidably interconnected by the use of projecting pins which are slidably received in elongated slots. Pins are formed on one edge of each wall panel for direct engagement in slots formed in one edge of a horizontally adjacent wall panel. Connecting strips having projecting pins are utilized for interconnecting vertically adjacent wall panels. Each of the panels and connecting strips can be slid into place. The projecting pins have enlarged heads and the slots include spaced apart enlarged openings interconnected by a narrow slit. The pins can be inserted in either of the enlarged openings and slid to the narrow

18 Claims, 34 Drawing Figures

KNOCKDOWN HOUSING STRUCTURE

BACKGROUND OF THE INVENTION

This invention relates to a housing structure, and more particularly to an easily assembled, easily knocked down building which can be erected through slidable engagement of the various component members.

Easily assembled building structures are often required for numerous purposes. For example, during the warm months, it is often desirable to erect a temporary shed in a backyard for housing summer equipment such as bicycles, garden tools and the like. Since the shed is taken down after a number of months, it must be of a type that can be easily erected and easily knocked down.

Other situations requiring such easily assembled building structure can include a child's playhouse, a camping house, a temporary office for a construction site, and others. An additional situation for a temporary dwelling is to conform with the Biblical requirement specified for the holiday of Tabernacles, or Sukkoth. In commemoration of the travels by the Children of Israel through the desert, the Bible specifies a celebration of the holiday in the fall season. As part of the celebration, a hut or temporary dwelling is erected for use during the holiday. The building is erected prior to the holiday, and shortly thereafter is knocked down, and therefore requires a structure that can be easily assembled and disassembled with minimal effort requiring almost no tools or skilled labor.

Accordingly, there is a general need for building structures which can be easily erected and knocked down. While various structures may be available for this purpose, they often present difficulties in the erection or in maintaining a secure structure. When the structure is easily assembled, frequently it is not sturdy enough to last for a sufficient period of time and results in a dangerous condition subject to collapse. In those situations where adequate sturdiness is provided, the interconnection becomes more complex and it is no longer a simple matter to erect, and knock down. In many cases, complex tools are needed and often skilled labor is also required.

Accordingly, there is a need for a housing structure that can be easily erected and knocked down without the need of skilled labor or complex tools, and which will remain sturdy and secure once erected.

SUMMARY OF THE INVENTION

It is therefore an object of the present invention to provide a knockdown housing structure that can be easily erected and disassembled without the need of skilled labor or complex tools.

A further object of the present invention is to provide a knockdown housing structure which will remain secure once erected.

Another object of the present invention is to provide a knockdown housing structure having a plurality of wall panels which can be easily interfitted and assembled into a desired housing shape.

Yet another object of the present invention is to provide a knockdown housing structure having interconnecting panels which can slidably lock into secure engagement and which provide a modular arrangement to achieve a desired structural configuration.

Briefly, in accordance with the present invention, there is provided a knockdown housing structure formed of a plurality of wall panels. The wall panels are interconnected through the use of a coupling arrangement, including projecting members which can slidably engage into elongated receiving slots to provide a secure locking relationship.

In an embodiment of the present invention, the projecting members are pins having enlarged heads. The elongated slots have a planar configuration including enlarged openings at opposing ends of a connecting narrow slit and a dovetail cross sectional configuration. Each of the openings can receive the enlarged head of the pin, whereby the pins can be inserted in either one of the openings and wedgingly slid in either of two opposing longitudinal directions toward the center of the slit.

The wall panels include pins projecting from one side edge, and slots on the opposing side edge so that horizontally adjacent wall panels can be directly interconnected to each other. The remaining two opposing side edges of the wall panel include elongated slots. Connecting strips are utilized for interconnecting vertically adjacent wall panels. The interconnecting strips include projecting pins extending from both its upper and lower surfaces which can slidably engage the vertically adjacent wall panels to interlock them.

Base strips are utilized in conjunction with corner strips to form a base frame which is interconnected to the wall panel sitting on it by using the connecting strips. The base frame includes the elongated slots which receive the projecting pins from the connecting strips.

Corner posts are provided which interfit into adjoining panels meeting at a respective corner. The corner posts include pins projecting from one edge and elongated slots contained in one of the adjacent edges.

Additional shaped panels such as triangular roof panels, rectangular frames for windows and doors, edge strips, and the like, are also provided in order to finish off the housing structure as desired.

The aforementioned objects, features and advantages of the present invention will, in part, be pointed out with particularity and will, in part become obvious from the following more detailed description of the present invention, taken in conjunction with the accompanying drawings, which form an integral part thereof.

BRIEF DESCRIPTION OF THE DRAWINGS

In the drawings.

In the various figures of the drawings, like reference characters designate like parts.

DESCRIPTION OF THE PREFERRED EMBODIMENT

Figure 1:
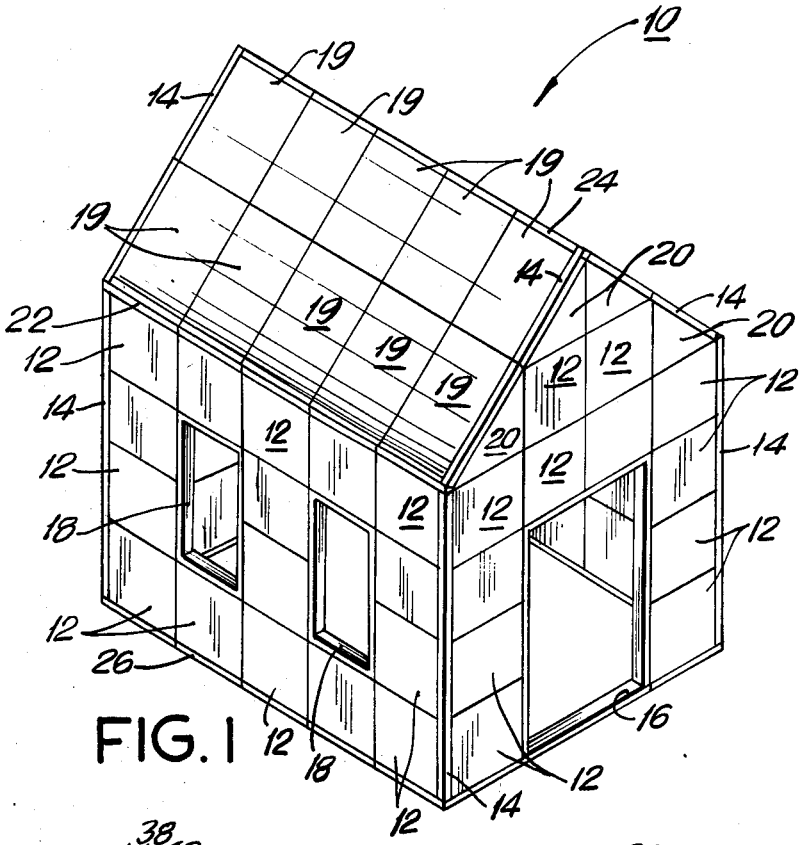
FIG. 1 is a perspective view of an assembled knockdown housing structure in accordance with the present invention.

Referring now to FIG. 1, there is shown a knockdown housing structure 10 in accordance with the present invention, formed of a number of individual wall panels 12 interconnected in modular relationship to form the structure shown. Various shapes can be put together using the individual modular wall panels.

The wall panels 12 are interconnected to form a composite wall. At the corner of the structure, corner posts 14 interconnect adjacent walls. A frame 16 is substituted for a number of panels 12 to define a doorway in which a door can be hung. Likewise, a frame 18 is substituted for wall panels to define a window frame in which a window can be hung.

Should the structure not need a roof, then only the peripheral walls would be formed leaving the top open. Such would be the case for a Tabernacle or Sukkah for celebrating the Biblical holiday of Tabernacles or Sukkoth. Should a roof be desired, as in the case of a playhouse, shed, or the like, the roof can also be constructed with panels 19, being the same type as the wall panels 12. In order to provide for a triangular roof arrangement, triangular roof panels 20 can be included and used to shape the roof into a triangular configuration. Finishing members are also provided, such as a corner edging 22 between the roof and the wall, and likewise upper corner pieces 24 at the very top.

The knockdown housing structure 10 is erected on a base frame 26 formed of interconnected strips. Each of the wall panels 12 is laterally connected to horizontally adjacent wall panels by direct interconnection to each other. However, vertically adjacent wall panels, as well as connection of the wall panels to the base frame, are interconnected by means of intermediate connecting strips.

In each situation, the interconnection is made by a sliding engagement of various parts, including projecting pins which slide into receiving slots. As a result, the panels, strips and other members are positioned adjacent to each other in an offset arrangement, and then slid into locking engagement. In this way, the housing structure can be easily assembled without the need of tools and without the requirement for skilled labor.

Figure 2:
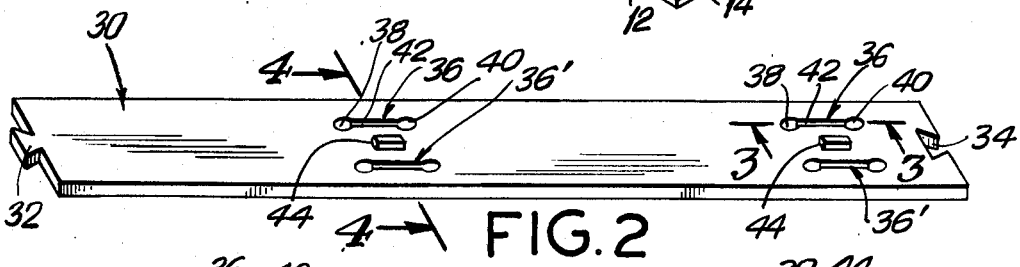
FIG. 2 a perspective view of a base strip which can interconnect to similar strips to form a base frame.
Figure 3:
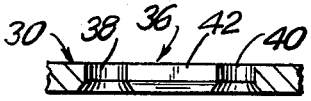
FIG. 3 a cross sectional view taken along lines 3—3 of FIG. 2, showing the elongated slot having an enlarged opening at the ends thereof.
Figure 4:
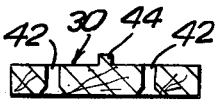
FIG. 4 is a cross sectional view taken along lines 4—4 of FIG. 2, showing the configuration of the connecting slit and showing upwardly projecting locating tab.

The base frame is formed of a series of interconnecting base strips and corner strips. FIGS. 2-4 show a single base strip 30 formed of elongated flat strip material. At one end is provided a projecting dovetail tenon 32. At the opposing end is provided a dovetail recessed mortise 34. The dovetail arrangement permits elongated interconnection of adjacent base members.

In spaced relationship along the base strip 30 are a series of elongated slot arrangements 36. Each elongated slot arrangement 36 includes a pair of substantially circular openings 38, 40 spaced apart by a narrow interconnecting slit 42. The entire bottom of elongated slot 36 is formed of a dovetail configuration, as shown in FIGS. 3 and 4. In this way, the circular openings 38, 40 have a narrower top which flares into a wider bottom. Likewise, the slits 42 also flare outwardly as then proceed downward from the top of the base strips 30.

Each of the elongated slots 36 are provided in paired relationship of each location, shown by the pair 36 and 36'. Positioned between a pair of elongated slots 36, 36' is an upwardly projecting locating tab 44.

Figure 5:
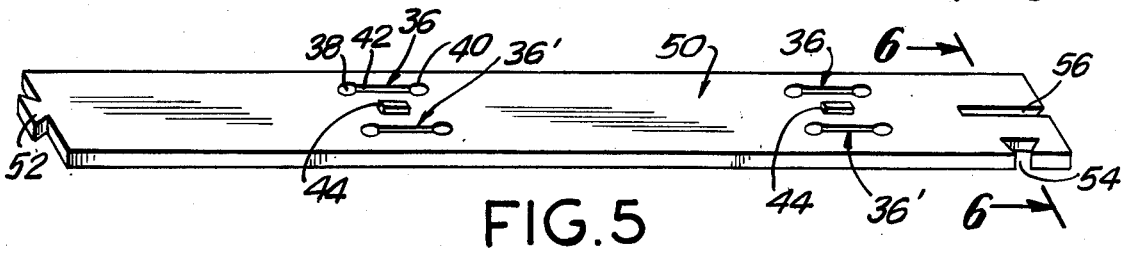
FIG. 5 a perspective view of a corner strip utilized to form a corner of the base frame.
Figure 6:
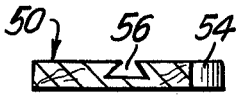
FIG. 6 is a cross sectional view taken along lines 6—6 of FIG. 5, showing the dovetail connection for receiving a corner block.

Referring to FIGS. 5 and 6, there is shown a corner strip 50 which is also utilized in the formation of the base frame. One corner strip 50 is utilized at each of the four corners. The corner strip 50 likewise includes a dovetail interconnecting arrangement with the projecting tenon 52 at one end. At the other end, the recessed mortise 54 is not provided in an axially directed position, but rather is offset laterally from one side edge adjacent the end. At the axial end, there is provided an elongated channel 56 partially extending through the thickness of the strip 50, and also having a dovetail mortise arrangement, as shown in FIG. 6. The corner strip 50 likewise includes the pairs of elongated slots 36, 36' with a projecting locating tab 44 spaced therebetween, in the same manner set forth above.

In both FIGS. 2 and 5, the particular strips 30 and 50 are shown to have two pairs of elongated slots 36, 36'. However, it should be understood, that the number of pairs spaced along the strips would be dependent upon the length of the strip being provided.

Figure 7:
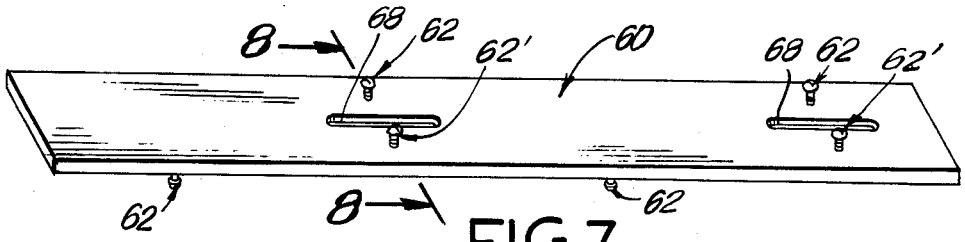
FIG. 7 a perspective view of a connecting strip for interconnecting vertically adjacent wall panels as well as connecting the base frame to the lowermost wall panel.
Figure 8:
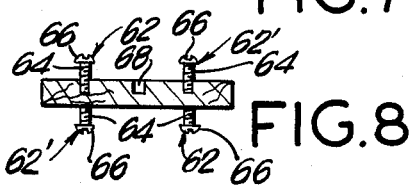
FIG. 8 a cross sectional view taken along lines 8—8 of FIG. 7, showing the projecting pins, and a recess for receiving a locating tab.
Figure 9:
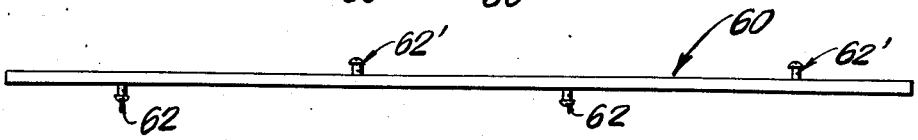
FIG. 9 an edge view of the connecting strip shown in FIG. 7, showing the reversibility of the connecting strip.
Figure 12:
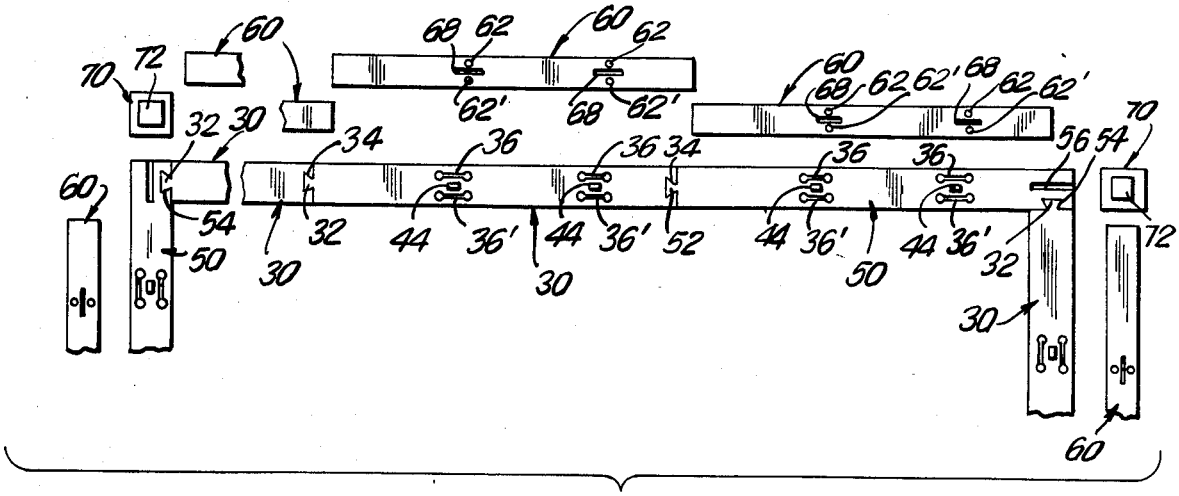
FIG. 12 is an exploded plan view showing the parts forming a base frame with overlying connecting strips.

FIGS. 7-9 show a connecting strip 60 which is used to interconnect the base and cover strips with wall panels, as well as for interconnecting vertically adjacent wall panels. The connecting strip 60 is also thin and flat and have a length size similar to that of the base strip 30 shown in FIG. 2, but the strip 60 has a narrower width than the strip 30. The corner strips 50 shown in FIG. 5, however, are longer than the base strips 30 of FIG. 2 and the connecting strips 60 of FIG. 7, the additional length of strip 50 being equal to the width of the strip 50, as well as the strip 30, which is also equal to the length of the channel 56 in the strip 50, as shown in FIG. 12 described below.

Positioned along the length of the strip 60, are pairs of projecting pins 62, 62'. The projecting pins are narrower at their base and provide a wider projected end. As shown, screws can be utilized which include a threaded shank portion 64 and an enlarged head 66. Such screws are easily insertable into the connecting strips 60. However, it should be appreciated that other types of projecting pins, or the like, can be utilized providing similar results.

The connecting strip 60 includes the pins on both its upper and lower surfaces, as shown in FIG. 9. Two laterally spaced apart pairs of pins are shown on the upper surface and likewise two laterally spaced apart pairs of pins are shown on the lower surface. In this way, the connecting strip is reversible. The arrangement of the pins are staggered between the upper and lower surfaces.

Positioned between each pair of pins 62, 62' is an elongated recess 68 partially extending into the thickness of the strip 60. It should be appreciated, that such recesses 68 would be provided both on the upper and the lower surfaces between the adjacent pairs of pins 62, 62'.

Figure 10:
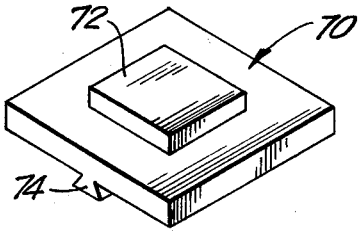
FIG. 10 is a perspective view taken from the top of a corner block for placement on the base for supporting the lowermost corner post.
Figure 11:
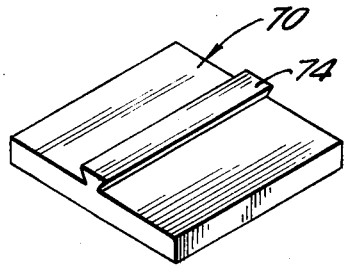
FIG. 11 is a perspective view of the corner block shown in FIG. 10 as taken from the bottom side, showing the dove tail projection for engaging the corner strip on the base frame.
Figure 16:
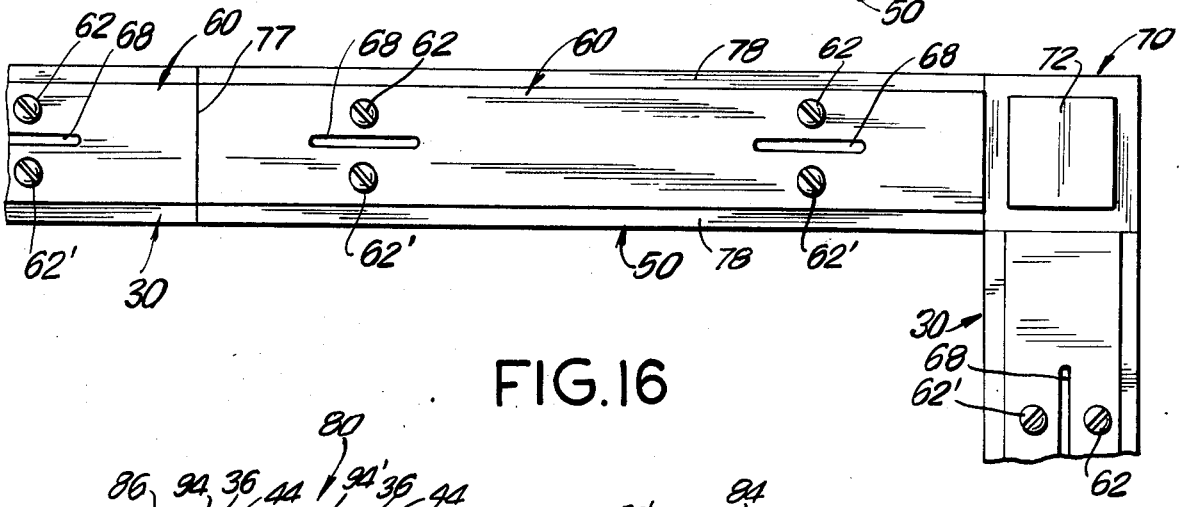
FIG. 16 is a partial plan view, showing an assembled base frame with the corner block and connecting strips in place.

FIGS. 10 and 11 show a connecting block 70 of substantially square configuration and proximate the same thickness of the connecting strip 60 of FIG. 7. One side of the connecting block 70 includes an upwardly projecting boss 72. On the opposing side, there is provided a projecting dovetail tenon 74. It is noted, that the block 70 has the same width as the strips 30, 50, where the boss 72 is slightly less than the width of the strip 60, as shown in FIG. 16.

The interconnection of the heretofore described members is shown in FIGS. 12–16 in the formation of the base frame. A plurality of base strips 30 are interconnected at their axial ends by means of the tenon 32 engaging the adjacent mortise 34. The number of base strips 30 utilized is dependent upon the peripheral frame size desired for the structure.

At each corner, there is utilized one corner strip 50 of the type shown in FIG. 5. The axial tenon 52 at one end of the camera strip 50 will engage in the mortise 34 and the axial end of the next adjacent base strip 30. Orthogonally, another base strip 30 would be used. The axial tenon 32 of the orthogonal base strip 30 would engage into the laterally positioned mortise 54 at the side of the corner strip 50 to secure the orthogonal arrangement.

Figure 13:
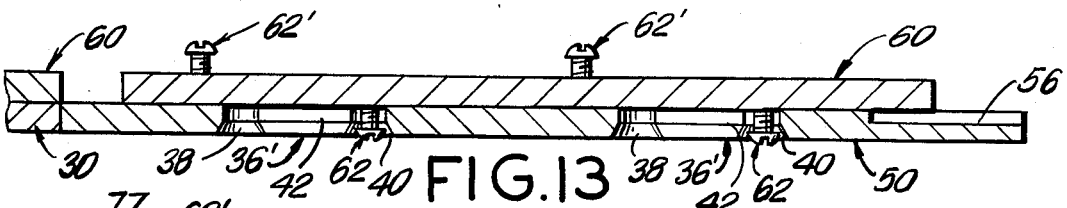
FIG. 13 is a cross sectional view showing a first step in the interconnection of a connecting strip onto a base strip.
Figure 14:
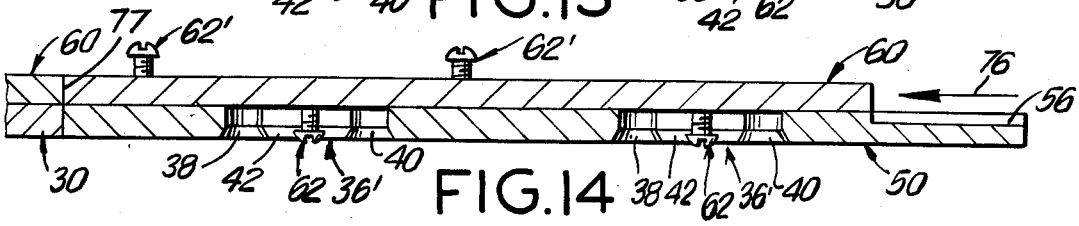
FIG. 14 is a view similar to that shown in FIG. 13, showing the interlocking step whereby the connecting strip is slid into locking engagement on the base strip.

A connecting strip 60 would overlie each of the base strips 30 and each corner strip 50. The connecting strip 60 would be placed over the base or corner strip as shown in FIG. 13 in offset relationship. The projecting pins 62, 62' of the connecting strip 60 would be inserted into either one of the enlarged openings 38, 40. As shown in FIG. 13, the pins 62, 62' of the connecting strips 60 are inserted into enlarged openings 40 at the right hand side of the base strip 50. After the pins 62, 62' are inserted, the connecting strip 60 is slid to the left, as shown by the arrow 76 in FIG. 14. The pins 62, 62' wedgingly engage the narrow slit 42 between the larger openings 38, 40 and is locked in place.

It should be appreciated, that if the openings 38 were utilized, the connecting strip 60 would be slid to the right to lock it in place. Once one connecting strip is inserted and locked in place, the next adjacent connecting strip is likewise inserted and slid in the same direction, so that all of the connecting strips 60 form an abutting relationship 77, as best shown in FIG. 16. The above abuttment provides longitudinal spaces 78 on opposite sides of the connecting strips 60, the function of which will be set forth below.

In positioning the connecting strip 60 on a base strip 30, as well as on a corner strip 50, the upwardly projecting locating tabs 44 are received slidably in the recesses 68 of the connecting strips 60 to be sure that the pins 62, 62' are properly inserted and slid in place.

Figure 15:
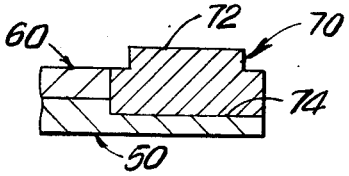
FIG. 15 is a cross sectional view taken at a corner of the base frame, showing the positioning of a corner block on the base frame.

Once all of the connecting strips 60 are secured onto the base strips 30 and corner strips 50, the corner blocks 70 can be secured in place, as shown in FIGS. 15 and 16, with the tenon 74 of block 70 being slidably received in the channel 56 in the corner strip 50. The upwardly extending boss 72 on the corner block 70 will project above the upper surface of base frame to be received in a recess provided in a corner post to be hereinafter described. Likewise, the pins 62, 62' on the upper surface of the connecting strips 60 would also be upwardly projecting for use in connection to wall panels, as will also hereinafter be described.

As is noted in FIG. 16, although the length of the connecting strip 60 proximates the length of the base strip 30, the width of the connecting strip is narrower than the width of both the base strips 30 and corner strips 50. This provides the slight edging or spacing 78 on either side of the connecting strip 60 for receiving the depending surfaces of the wall panels, as will hereinafter be described, in order to cancel the connecting strip and position it interiorly of the wall panels to provide a finished appearance to the building structure.

Figure 17:
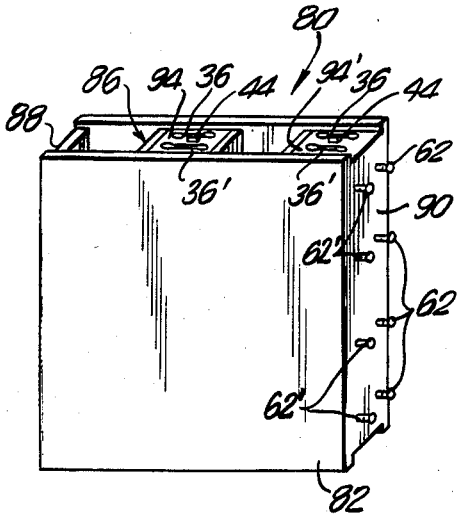
FIG. 17 is a perspective view of a wall panel taken from one side thereof.
Figure 18:
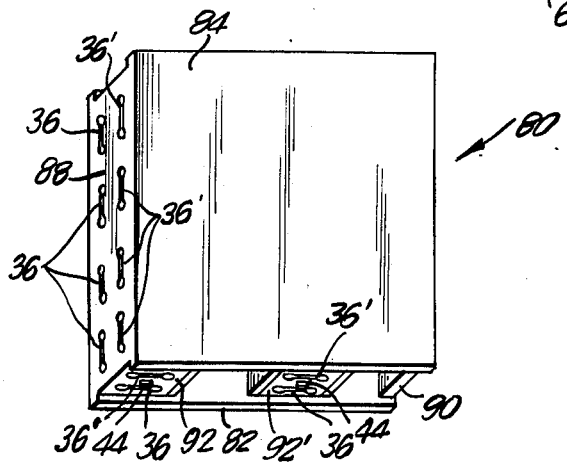
FIG. 18 is a perspective view of the wall panel shown in FIG. 16, showing the other side thereof.
Figure 19:
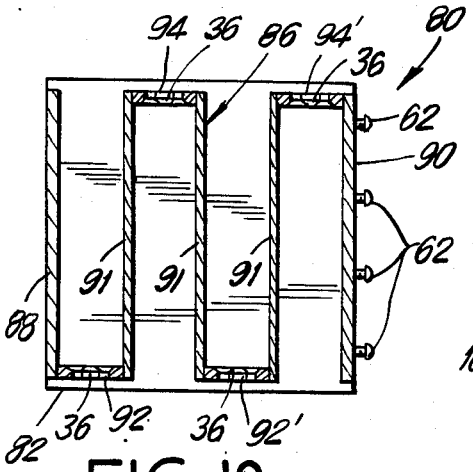
FIG. 19 is a cross sectional view taken through a wall panel, showing the serpentine arrangement of the interior wall.

The wall panel structure is best shown in FIGS. 17–19. Each wall panel 80 includes front and rear walls 82, 84 of proximate square configuration. In the spacing between the front and rear walls 82, 84 is an interior wall 86 formed in a serpentine arrangement as best shown in FIG. 19. The interior wall 86 defines one lateral side edge wall 88 and an opposing lateral side edge wall 90 with a plurality of interior wall sections 91. At the ends of the interior wall sections 91 and the other two edge walls 88, 90, there are provided spaced apart side edge wall sections 92, 92′ on one side, and sections 94, 94′ on the other side.

The lateral side edge wall 90 includes projecting pins 62, 62′ formed in pairs and spaced apart along the wall 90. The opposing lateral side edge wall 88 includes receiving slots 36, 36′ formed in pairs and spaced apart along the wall 88. Along both the wall sections 92, 92′ on one side, and sections 94, 94′ on the other side, there are provided the elongated slots 36, 36′ in pairs. It is therefore appreciated, that the projecting pins 62, 62′ are provided on only one of the four side edges, while the elongated slots 36, 36′ are provided on all of the other three side edges of the panel 80.

The two top and bottom edges having only the sections 92, 92′ and 94, 94′ are slightly recessed from the peripheral edge of the front and rear wall 82, 84, as best shown in FIG. 19. Such recess will accommodate the thickness of the connecting strip 60 so as to conceal the connecting strip 60 and seat it internally of the wall panels 80 to provide a smooth finished look on the exterior of the housing structure. Likewise, on these wall sections 92, 92′ and 94, 94′ there are provided the projecting locating tabs 44 as heretofore described with respect to the base and corner strips 30 and 50. The projecting tabs 44 are not provided on the lateral edge 88.

Figure 20:
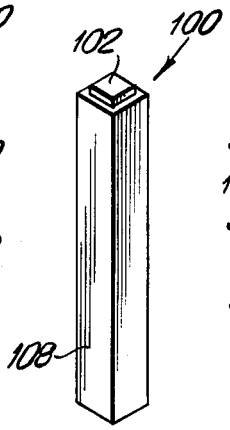
FIG. 20 is a perspective view of a corner post taken from the exterior thereof.
Figure 21:
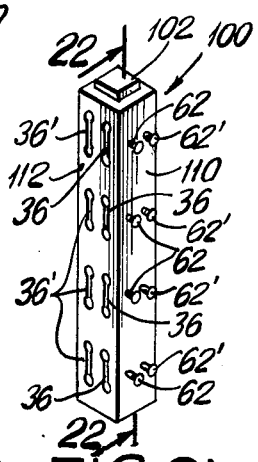
FIG. 21 is a perspective view of the corner post shown in FIG. 20, taken from the interior thereof and showing the projecting pins on one side and the elongated slots on the other side.
Figure 22:
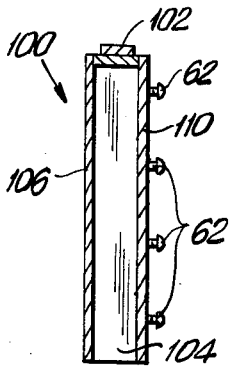
FIG. 22 is a cross sectional view taken along lines 22—22 of FIG. 21.

As shown in FIGS. 20–22, corner posts 100 are provided of a height proximate the height of the wall panel 80. The corner posts 100 include a projecting boss 102 at one axial end, and are hollow to provide a recess 104 at the other axial end. The two exterior surfaces 106, 108 of the corner post 100 are smooth to provide a finished corner edge. On one interior surface 110, there are provided pairs of the adjacent projecting pins 62, 62′ spaced along the length of the corner post. Along the remaining adjacent interior surface 112, there are provided pairs of the elongated slots 36, 36′ spaced along the length of the post.

It should be appreciated, that the number of projecting pins 62, 62′ on each of the panels 80 shown in FIGS. 17 and 18, and the number of pins 62, 62′ on the corner post 100 shown in FIG. 21, are substantially the same. Likewise, the number of elongated slots 36, 36′ shown in FIG. 18 on the side 88 of the wall panel 80, and the number of slots 36, 36′ on the side 112 of the corner post 100 shown in FIG. 21, would likewise be the same. On the other hand, the number of elongated slots 36, 36′ on the other two wall sections 92, 92′ and 94, 94′ of the wall panel 80 would correspond in number to the number of projecting pins 62, 62′ on a connecting strip 60 shown in FIG. 7.

Figure 23:
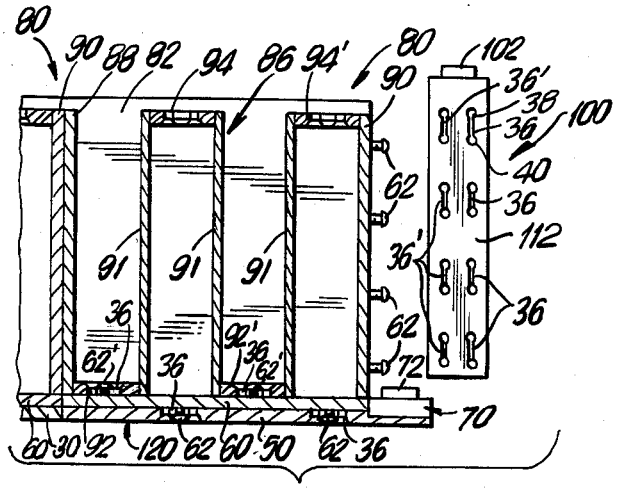
FIG. 23 is a cross sectional view, showing the placement of a corner post onto an adjacent wall panel overlying a corner block.

The interconnection of the wall panels and corner posts will now be described with regard to FIGS. 23–26. As shown in FIG. 23 a wall panel 80 is interconnected onto the previously assembled base portion shown in FIG. 16 and shown generally at 120. The base frame 120 includes the corner strip 50, and the overlying connecting strip 60. The upwardly projecting pins 62, 62′ on the connecting strip 60 would be inserted into the enlarged openings 38 or 40 on the sections 92, 92′ of the wall panel 80 and then slid in place. In this manner, each wall panel 80 is slid onto the connecting strip 60 beneath it.

One wall panel 80 is connected to the horizontally adjacent wall panel 80 by having its pins 62, 62′ in its lateral wall 90 connected into the slots 36, 36′ in the adjacent wall 88 of the next wall panel 80.

Once the final wall panel is positioned along one side of the building structure, a corner post 100 is placed in position. The corner post 100 would be aligned over a corner block 70 with the projecting boss 72 inserted within the recess 104 in the connecting post 100. The pins 62, 62′ projecting from the edge wall 90 of the last assembled wall panel 80 would be slidably inserted into the one of the holes 38, 40 of the elongated slots 36′ on the corner post and then the corner post is slid down into place.

In assembling the wall panels 80 onto the underlying connecting strips 60, the locating tabs 44 on the wall panels would be slid into the receiving recesses 68 on the connecting strips 60.

Figure 24:
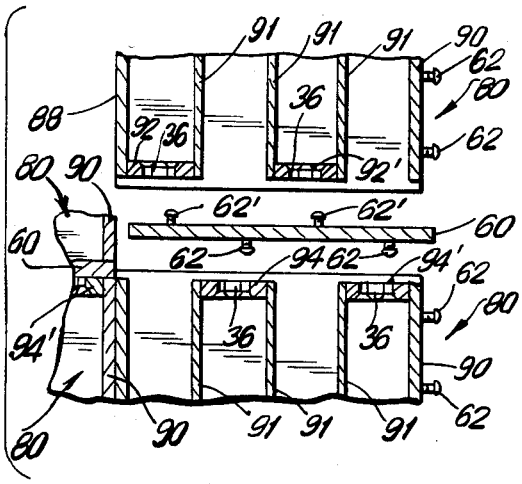
FIG. 24 is an exploded cross sectional view showing the use of a connecting strip interconnecting vertically adjacent wall panels.
Figure 25:
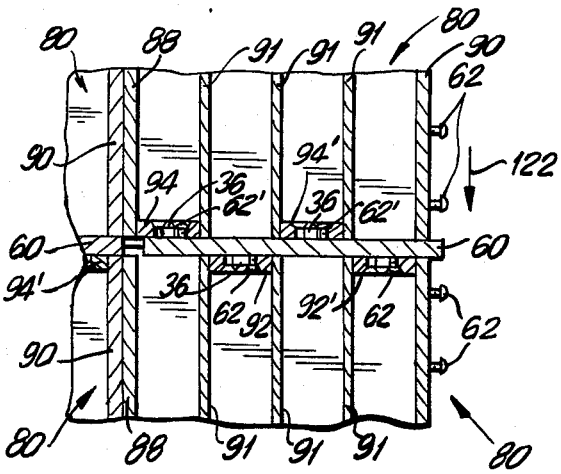
FIG. 25 is a partially assembled view similar to that shown in FIG. 24, showing a further step in the assembly of vertically adjacent wall panels in accordance with one method.
Figure 26:
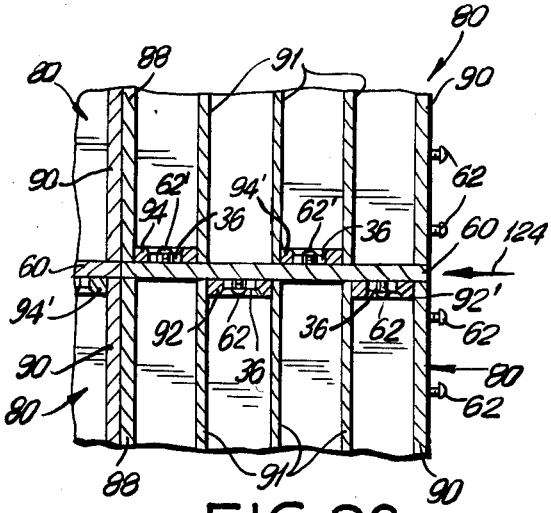
FIG. 26 is a view similar to that shown in FIG. 25, showing the sections in their assembled conditions.

Once a lower peripheral layer of the housing structure has been assembled, the next layer above it can then be assembled. Such assembly can take place as shown in FIGS. 24–26 by providing one connecting strip 60 as an interconnecting member between adjacent vertical wall panels 80. The pins 62, 62′ depending downward from connecting stop 60 are inserted into the slots 36, 36′ on the panel 80 below it, while the pins 62, 62′ projecting upward from the connecting strip 60 go into the slots 36, 36′ in the wall panel 80 above it.

The above interconnection can be achieved by first inserting the connecting strip 60 in place on the lower panel 80, and then sliding the connecting strip to lock the strip in place on the lower panel 80. The upper panel 80 can then be inserted so that the plots therein receive the upper pins of the strip 60, and then the upper panel 80 can be slid to lock the upper panel 80 in place on the strip 60.

Alternatively, as shown in FIGS. 25 and 26, the assembly can be made by positioning the upper wall panel onto the connecting strip 60 when simultaneously positioning the connecting strip 60 on the lower wall panel 80 therebelow. In this way, both the upper and lower wall panels 80 will be already in place by first inserting the upper wall panel 80 downward to connect it to the adjacent panel 80 on the left, as shown by the arrow 122. The connecting strip 60 will be projecting outwardly while the two panels 80 are in place. As shown in FIG. 26, the connecting strip 60 is then pushed to the left into place, as shown by the arrow 124, and simultaneously locks the pins 62, 62′ of the strip 60 in place between the lower panel 80 and the upper panel 80 in the manner set forth above whereby the head 66 of the pin prevents the pin from being pulled perpendicularly out from the narrow slit 42 of the slot. Either of the above two methods can be used to assemble individual wall panels vertically with respect to each other. The connecting strip 60 is enclosed between the wall panels fitting within the recesses provided between the walls of the adjacent wall panels as heretofore explained.

Figure 27:
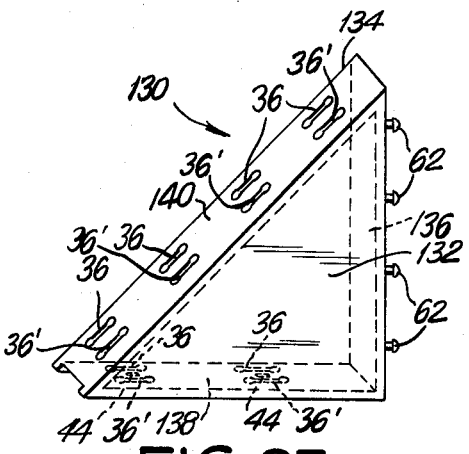
FIG. 27 is a perspective view of a triangular roof panel taken from one side thereof.
Figure 28:
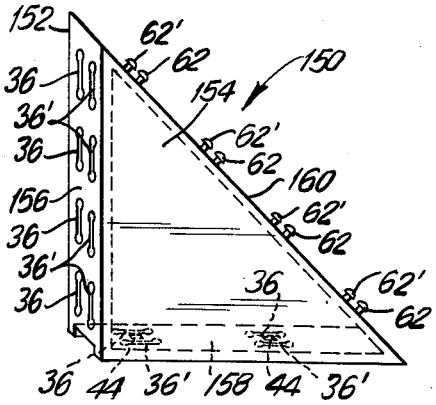
FIG. 28 is a perspective view of the roof panel shown in FIG. 27, taken from the other side thereof.

Referring now to FIGS. 27 and 28, it will be shown how a roof section can be formed into a triangular configuration. Referring back to FIG. 1, it will be noted that certain triangular sections are required in order to complete the triangular shaped roof. One such triangular roof section is shown in FIG. 27 as panel 130. Panel 130 includes abutting wall faces 132, 134 separated by three peripheral outer interconnecting edge walls 136, 138 and 140. Two of these edge walls 136, 138 are at right angles. The hypotenuse edge wall 140 interconnects the other two. One edge wall 136 has the pairs of projecting pins 62, 62' while the other two edge walls 138, 140 include the pairs of slots 36, 36', in the manner mentioned above, whereby the tabs 44 are disposed between the slots 36, 36' in the bottom edge wall 138.

In FIG. 28, there is shown another triangular panel 150 having front and rear surfaces 152, 154 separated by peripheral edge walls 156, 158 at right angles to each other, and the hypotenuse edge wall 160. In this case, the hypotenuse edge wall 160 contains the projecting pins 62, 62', while the other two edge walls 156, 158 include the slots 36, 36', also in the manner mentioned above, whereby the tabs 44 are again disposed between the slots 36, 36' in the bottom edge wall 158.

Figure 29:
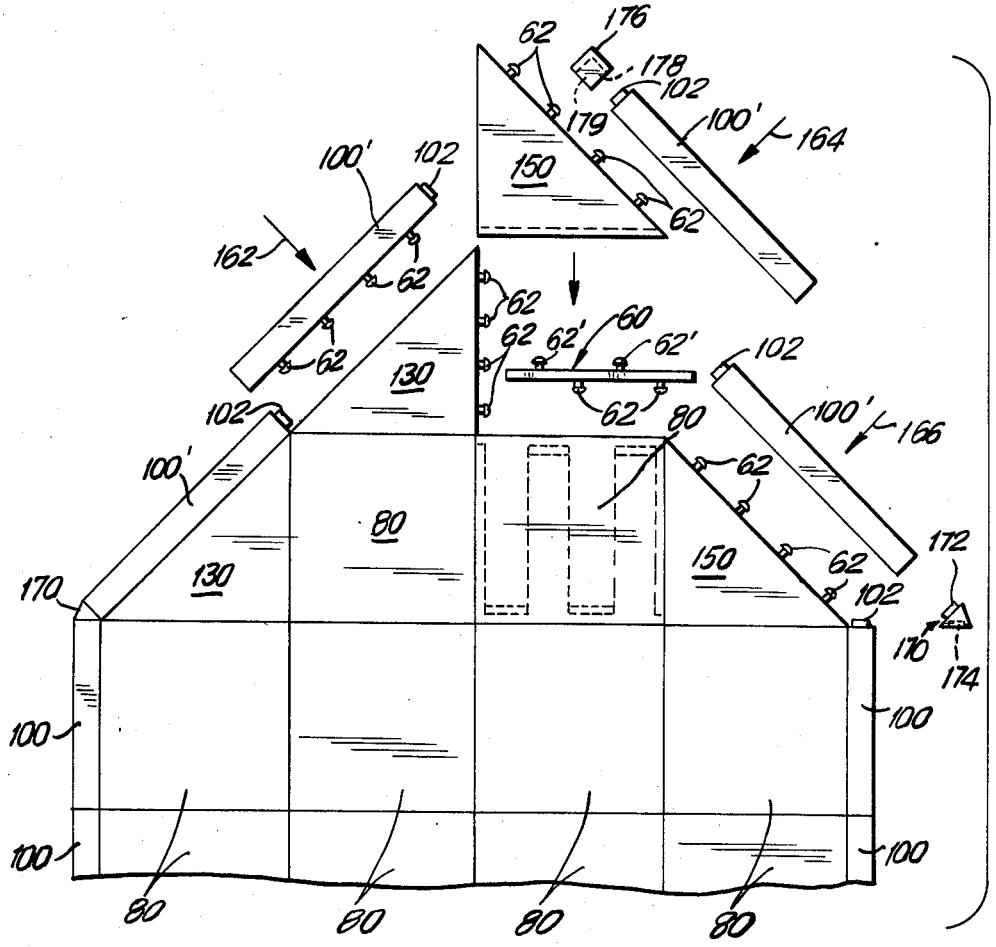
FIG. 29 is an exploded view showing the assembly of the roof of the housing structure.

The construction of the roof is shown in FIG. 29, wherein individual wall panels 80 of the type shown in FIGS. 17 and 18 would be utilized to construct the wall and portions of the roof itself. Two triangular sections 130 of the type shown in FIG. 27 would be placed on the left edge. The corner posts 100' would be inserted over the triangular sections 130, as shown by the arrow 162. It is noted, that the posts 100' on the roof are preferably made longer to be the same size as the edge wall 140 of the triangular panel 130.

On the right side of the roof, two of the triangular panels 150, as shown in FIG. 28, would be utilized to form the angled side. These would again be finished off by the corner posts 100, which would be inserted in place as shown by the arrows 164, 166. Here again, the roof posts 100' are preferably made longer to be the same size as the edge wall 160 of the triangular panel 150. It should be understood that the same interconnecting strips 60 shown in FIG. 7 would be utilized to interconnect the triangular panels 130, 150 to the wall panels 80 therebeneath.

A corner triangular joint 170 is provided to fit beneath the angled roof corner post 100' thereabove and the vertical corner post 100 therebeneath. A boss 172 projects from one side of the joint 170 and a recess 174 is provided at the other side to secure the corner joint 170 in place to function the same as the boss 102 and recess 104 of the post 100. At the uppermost top of the roof, there is provided a finishing joint 176 which includes recesses 178, 179 along both sides to accommodate the bosses 102 extending from the roof corner posts 100' to which the finishing joint 176 is connected. Of course, as heretofore explained, a roof need not be provided and the top can remain open should such be required, as for example in the construction of a Tabernacle for the Sukkoth holiday. Accordingly, the roof panels 19 shown in FIG. 1 are connected in a similar manner, where the roof panels 19 are similar to the panels 80. However, the roof panels 19 are preferably longer than the panels 80 to be the same length as the above mentioned roof posts 100'.

Figure 30:
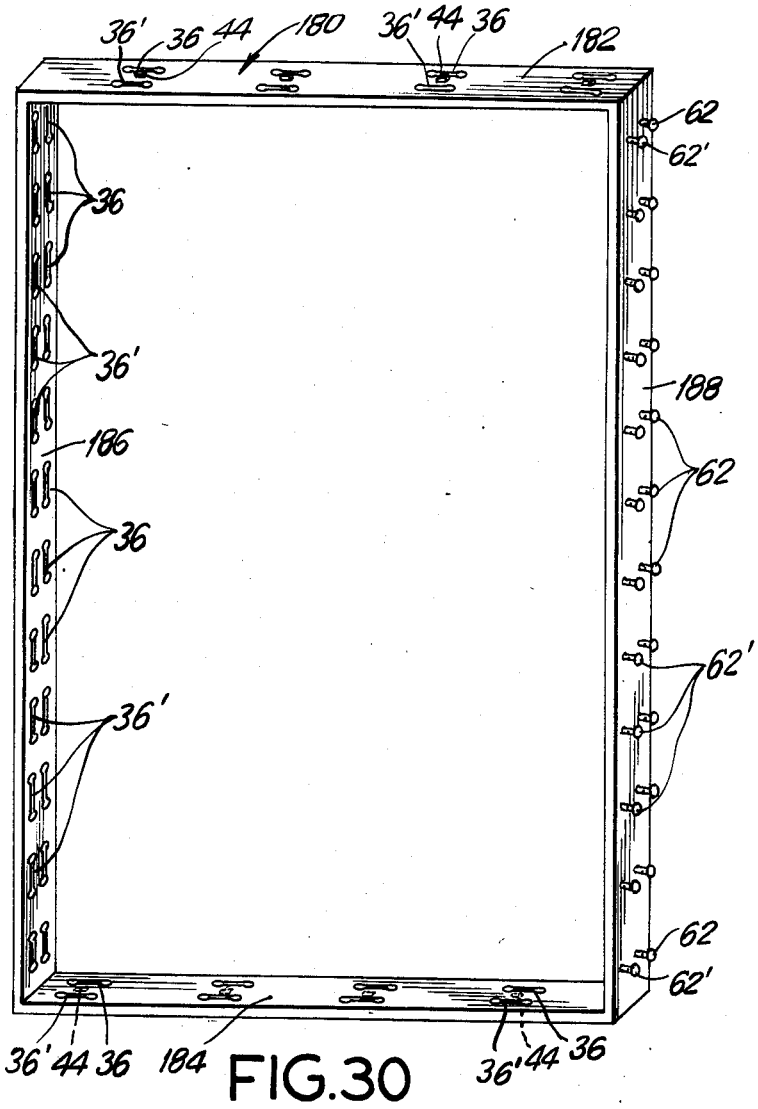
FIG. 30 is a perspective view of a frame insertable within the housing structure establishing a doorway in which a door can be hung.
Figure 31:
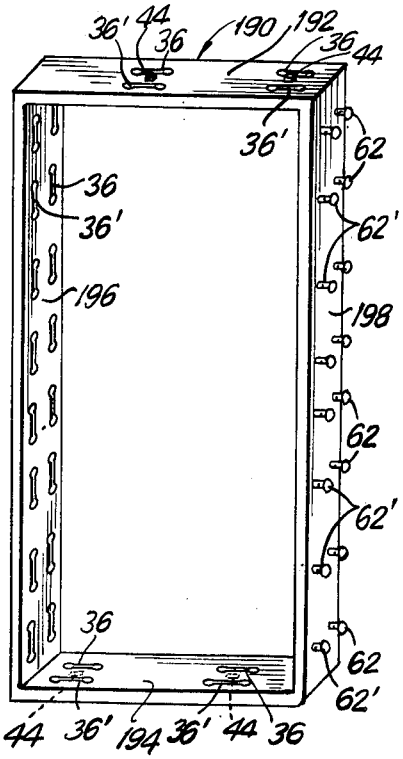
FIG. 31 is a perspective view of a frame for use in place of sections of wall panel for establishing a window frame in which the window can be hung.

If a door is to be placed at a location, a frame 180 shown in FIG. 30 could be utilized. The frame would typically replace a number of panels 80. As shown, it replaces three vertical panels 80 and two horizontal panels 80 to accommodate a door. The frame 180 includes peripheral upper and lower frame members 182, 184 and side frame members 186, 188. Projecting from the frame member 188 are the pins 62, 62' in pairs, corresponding in number to that normally provided on the wall panels that it replaces. On all of the other sides, there are provided the pairs of elongated slots 36, 36'. On the upper and lower wall sections 182, 184, there are also included the projecting tabs 44 for locating purposes. A suitable door would be hung within the frame 180.

A window can be provided by using the window frame 190 shown in FIG. 37. This frame 190 would also replace a number of panels 80, being similar to the door frame 180, but being smaller in size. As shown in FIG. 1, the window frame 190 replaces one horizontal wall panel 80 and two vertical wall panels 80. The window frame 190 includes upper and lower frame members 192, 194 and lateral side frame members 196, 198. Pins 62, 62', in pairs, are on the side 198. All the other sides include elongated slots 36, 36', in pairs. On the upper and lower sections 192, 194, there are also provided the locating projecting tabs 44. A suitable window would be mounted within the frame 190.

Figure 32:
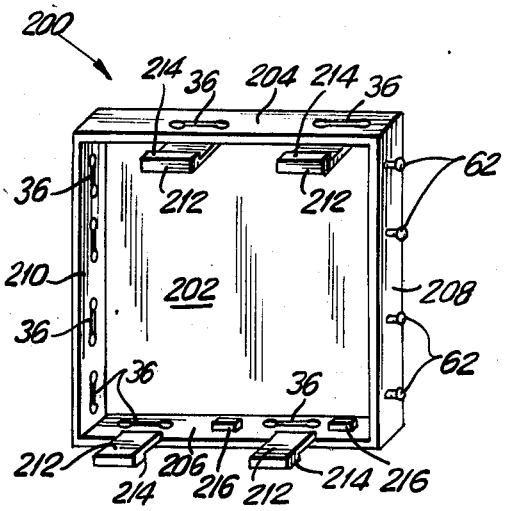
FIG. 32 is a perspective view, showing one half of a wall panel in accordance with another embodiment of the present invention.

Although the wall panels 80 shown in FIGS. 17 and 18 include front and rear walls, such wall panels can also be provided in half panels as shown in FIG. 32. Specifically, the half wall panel 200 includes a surface 202 on one side with a peripheral frame including the upper frame member 204, the lower frame member 206, and two side frame members 208, 210. The frame member 208 includes the pins 62. However, it is noted that since it is only a half thickness, the pins are provided in only a single number rather than in pairs, as heretofore described. Likewise, the elongated slots 36, which are provided on the other three peripheral walls, are also single elongated slots rather than in pairs.

Figure 33:
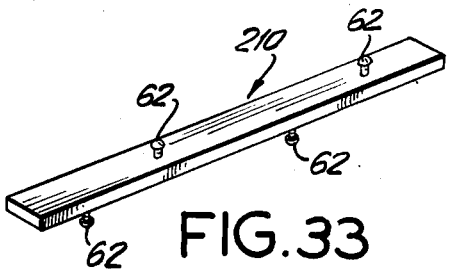
FIG. 33 is a perspective view of a connecting strip in accordance with the present invention for use with the half wall panel shown in FIG. 32.

Because only a single pin 62 and single elongated slot 36 are provided in the half thickness wall panel 200 of FIG. 32, a corresponding half thickness of connecting strip 210 would be utilized, as shown in FIG. 33. In this case, the pins 62 project upwardly and downwardly from the surface of the strip 210. Again, the pins 62 are provided in singular fashion rather than in pairs, and would be utilized to interconnect the wall sections 204, 206 of adjacent panels 200, shown in FIG. 32.

The wall panels 200 of FIGS. 32 can be used as is, whereby the exterior would be finished and the interior would remain with an open face or vice versa. Alternately, the half wall panel 200 shown in FIG. 32 can be interlocked with another similar half wall panel 200 to provide a composite panel similar to that provided in FIG. 17.

The interlocking of the two panels 200 can be achieved by means of the projecting arms 212 provided along the upper and lower wall edges 204, 206. These terminate in outwardly extending finger portions 214. Wedge shaped tabs 216 are provided interiorly of the upper and lower wall edges 204, 206 spaced from the arms 212.

Figure 34:
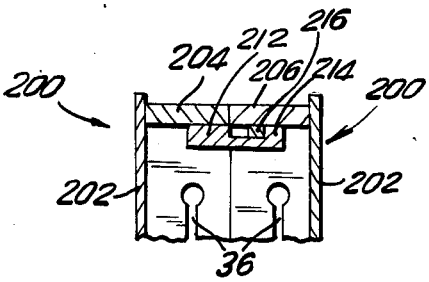
FIG. 34 is a cross sectional view showing the top of two interconnected wall panels of the type shown in FIG. 32.

As shown in FIG. 34, two such adjacent wall panels 200 can then be interlocked by permitting the arms 214 of edge 204 and 206 to extend into each of the adjacent wall panels so that the fingers 214 from the edge 204 engage the wedge shaped tabs 216 on the edge 206, and the fingers 214 from the edge 206 engage the tabs 216 on the edge 204. The two wall sections are slid relative to each other to interlock the fingers 214 and tabs 216 to form a composite which now has both front and rear walls 202. Once the two sections have been combined as shown in FIG. 34, the double type of connecting strip 60 shown in FIG. 7 can be utilized in a standard manner.

There has been disclosed heretofore the best embodiment of the invention presently contemplated. However, it is to be understood that various changes and modifications may be made thereto without departing from the spirit of the present invention.

What is claimed is:

1. A knockdown housing structure comprising:

a plurality of wall panels;

coupling means for interconnecting said wall panels;

said coupling means including projecting members and elongated receiving slots;

said projecting members and slots being slidably engaged into a locking relationship;

said slots being provided along opposing outer edges of said panels;

said projecting members including projecting pins with enlarged heads; and elongated connecting strips for interconnecting adjacent panels, said pins projecting from opposing sides of said strips and engaging said slots.

2. A knockdown housing structure as in claim 1, wherein said slots have a dovetail configuration to capture said enlarged heads of said pins.

3. A knockdown housing structure as in claim 1, wherein said slots include enlarged openings at opposing ends of a connecting narrow slit, said openings receiving said enlarged head, and said slit preventing said enlarged head from being perpendicularly pulled therethrough for securing said pins, whereby said pins are locked by sliding in either longitudinal direction from said openings into said slit.

4. A knockdown housing structure as in claim 1, wherein second pins project from a side edge of each wall panel, and second slots are provided along an opposing side edge of said wall panel

5. A knockdown housing structure as in claim 4, and comprising corner posts for slidably locking onto adjacent wall panels of a corner of the structure, third pins projecting from one side of the corner post and third slots provided on an adjacent side of the corner post.

6. A knockdown housing structure as in claim 5, wherein said corner posts comprise a raised interlocking boss at one axial end and a mating recess at the other axial end, said corner posts being vertically interconnected.

7. A knockdown housing structure as in claim 4, and further comprising roof panels, said roof panels being triangular in shape and having pins projecting from one side edge and slots provided along the other two side edges.

8. A knockdown housing structure as in claim 4, and further comprising opening frame members for subsitiution of a number of wall panels for insertion of a window, door or the like, said frame members having pins projecting from one side and containing slots on the other sides thereof.

9. A knockdown housing structure as in claim 1, and further comprising interconnecting elongated base strips for forming a base frame, said base strips containing slots for receiving the projecting pins of said connecting strip, and first frame coupling means at opposite ends of said base strips for longitudinally interconnecting adjacent base strips together.

10. A knockdown housing structure as in claim 9, and comprising elongated corner strips for connection at each corner of the base frame, said corner strips containing slots, and second frame coupling means at one axial end and at a lateral edge adjacent the other axial end of said corner strip for longitudinally interconnecting to one base strip and another orthogonal interconnected base strip to provide a corner of the base frame.

11. A knockdown housing structure as in claim 10, wherein said first and second frame coupling means provide dovetail interconnections.

12. A knockdown housing structure as in claim 11, and comprising a corner block for supporting a corner post, a projecting boss on the corner block for interlocking into a mating recess in said corner post, a depending dovetailed projection on the corner block, and a dovetailed slot longitudinally extending in said other axial end of said corner strip for receiving said dovetailed projection.

13. A knockdown housing structure as in claim 9, and comprising a locating projecting tab associated with at least some of said slot, and an elongated recess associated with at least some of said pins for receiving said tab so that interconnected parts can be conveniently oriented with respect to each other.

14. A knockdown housing structure as in claim 1, wherein said panels are rectangular and include second projecting pins along one side edge and second slots along the other opposing side edge, one panel being directly interconnected to a horizontally adjacent panel by said second pins of said one panel engaging in said second slots of said horizontally adjacent panel, and being connected to vertically adjacent panels through said connecting strips secured between said outer edges of said one panel and said vertically adjacent panels.

15. A knockdown structure as in claim 14, wherein said outer edges of said panels utilizing said connecting strips are recessed to recive at least part of the thickness of said connecting strip, said connecting strips being concealed between adjacent interconnecting panels.

16. A knockdown housing structure as in claim 14, wherein said panels comprise front and rear wall surfaces and an interior wall, said interior wall having a serpentine arrangement including lateral edges, one of which supports said second projecting pins and the other of which contains said second slots, the other two side edges including spaced sections of said serpentine interior wall with said spaced sections containing said first mentioned slots.

17. A knockdown housing structure as in claim 14, wherein said panels comprise an open rectangular configuration including a surface wall and four upstanding edge walls, and interlocking members on said edge walls for coupling to a corresponding panel to thereby form a composite wall panel.

18. A knockdown housing structure as in claim 17, wherein said interlocking members comprise arms extending from two opposing ones of said edge walls and terminating in a retaining finger, and locking tabs interiorly of said opposing edge walls engaged by said retaining fingers.

* * * * *